US010289023B1

(12) United States Patent
Kasukawa

(10) Patent No.: US 10,289,023 B1
(45) Date of Patent: May 14, 2019

(54) CAPTURE OF DEVELOPER LEAKING FROM DEVELOPING DEVICE

(71) Applicants: KABUSHIKI KAISHA TOSHIBA, Tokyo (JP); TOSHIBA TEC KABUSHIKI KAISHA, Tokyo (JP)

(72) Inventor: Masayuki Kasukawa, Misato Saitama (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/880,034

(22) Filed: Jan. 25, 2018

(51) Int. Cl.
*G03G 15/08* (2006.01)

(52) U.S. Cl.
CPC ..... *G03G 15/0817* (2013.01); *G03G 15/0893* (2013.01); *G03G 15/0898* (2013.01); *G03G 2215/0119* (2013.01); *G03G 2215/0819* (2013.01)

(58) Field of Classification Search
CPC ..... G03G 15/0817; G03G 2215/0119; G03G 15/0898; G03G 15/0891; G03G 15/0893; G03G 2215/0819; G03G 2215/0822
See application file for complete search history.

(56) References Cited

U.S. PATENT DOCUMENTS 5,530,521 A * 6/1996 Lee ..... G03G 21/12 399/29
7,706,714 B2 4/2010 Kamimura
2015/0016837 A1* 1/2015 Kitajima ..... G03G 15/0942 399/104
2016/0085180 A1* 3/2016 Honda ..... G03G 15/0891 399/254

FOREIGN PATENT DOCUMENTS

JP 2003316154 A * 11/2003

* cited by examiner

*Primary Examiner* — David M. Gray
*Assistant Examiner* — Laura Roth
(74) *Attorney, Agent, or Firm* — Kim & Stewart LLP

(57) ABSTRACT

According to one embodiment, a developing device includes a casing for accommodating a developer, the casing extending in a first direction and including a first insertion portion and a first through-hole that extends from the first insertion portion in a second direction, a first sealing member inside the first insertion portion, and a first rotating body extending in the first direction through the first insertion portion and configured to transport and agitate the developer in the casing. The first sealing member is in contact with an outer surface of the first rotating body and configured to slide along the outer surface of the first rotating body.

14 Claims, 6 Drawing Sheets

CAPTURE OF DEVELOPER LEAKING FROM DEVELOPING DEVICE

FIELD

Embodiments described herein relate generally to a developing device and an image forming apparatus.

BACKGROUND

An image forming apparatus includes a developing device that accommodates toner, and supplies the toner to a surface of a photoconductive drum. The developing device includes a mixer inside a casing. The developing device causes developer containing toner to circulate inside the casing using the mixer. End portions of the mixer are rotatably supported by the casing. There is some possibility that the developer in the casing may leak from the casing through the end portion of the mixer. When the developer leaks from the inside of the casing, a rotational failure of the mixer can occur as the leaked developer adheres to and then binds the moving portions of the mixer on the outside of the casing.

DETAILED DESCRIPTION

A developing device includes a casing for accommodating a developer, the casing extending in a first direction and including a first insertion portion and a first through-hole that extends from the first insertion portion in a second direction, a first sealing member inside the first insertion portion, and a first rotating body extending in the first direction through the first insertion portion and configured to transport and agitate the developer in the casing. The first sealing member is in contact with an outer surface of the first rotating body and configured to slide along the outer surface of the first rotating body.

Hereinafter, an image forming apparatus and the developing device according to the embodiment will be described with reference to drawings.

Figure 1:
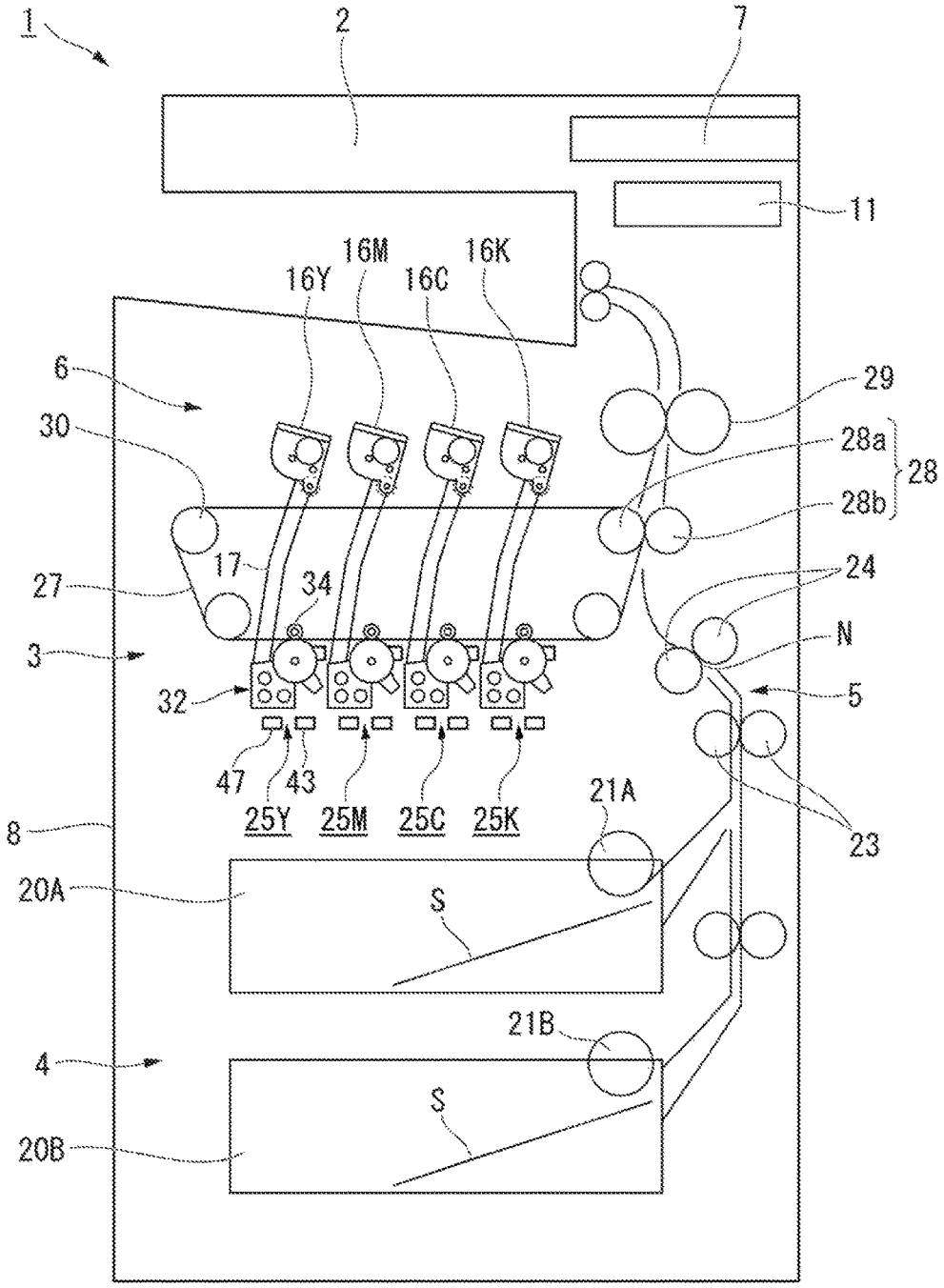
FIG. 1 is a schematic view of an image forming apparatus according to an embodiment.

FIG. 1 is a schematic view of the image forming apparatus according to an embodiment.

As illustrated in FIG. 1, an image forming apparatus 1 includes a scanning unit 2, a printing unit 3, a sheet accommodating unit 4, a transport unit 5, a toner supply unit 6, a display unit 7, and a control unit 11. In the example of the image forming apparatus 1 described, the image forming apparatus is assumed to be placed substantially flat on a horizontal plane. A side of the image forming apparatus 1 illustrated in FIG. 1 will be referred to as a front side, and the opposite side will be referred to as a rear side. A longitudinal direction (also referred to as a first direction) is along a depth of the image forming apparatus 1 from the front side to the rear side. A direction orthogonal to a longitudinal direction and parallel to a height direction (up-down page direction in FIG. 1) of the image forming apparatus 1 is referred to as the vertical direction. A direction orthogonal to the longitudinal direction and the vertical direction will be referred to as a horizontal direction (also referred to as a second direction).

The scanning unit 2 reads image information of an target to be copied as brightness and darkness of light. The scanning unit 2 outputs the read image information to the control unit 11.

The printing unit 3 forms an output image (hereinafter, referred to as "toner image") using a developer containing toner and a carrier, based on image information from the scanning unit 2, or received from outside of the image forming apparatus 1. The printing unit 3 transfers the toner image onto the surface of a sheet S. The printing unit 3 fixes the toner image onto the sheet S by applying heat and a pressure to the toner image on the surface of the sheet S.

The sheet accommodating unit 4 supplies the sheet S to the printing unit 3 sheet by sheet. The sheet accommodating unit 4 includes a plurality of sheet feeding cassettes 20A and 20B. Each of the sheet feeding cassettes 20A and 20B accommodates sheets S whose size and types can be preset. Each of the sheet feeding cassettes 20A and 20B includes pickup rollers 21A and 21B, respectively. Each of the pickup rollers 21A and 21B takes out the sheet S individually from each of the sheet feeding cassettes 20A and 20B. The pickup rollers 21A and 21B supply the sheet S which is taken out to the transport unit 5.

The transport unit 5 includes a transport roller 23, and a registration roller 24. The transport unit 5 transports the sheet S supplied by the pickup rollers 21A and 21B to the registration roller 24. The registration roller 24 transports the sheet S according to a timing in which the printing unit 3 transfers the toner image to the sheet S. The transport roller 23 causes a tip end of the sheet S in the transport direction to be in contact with a nip N of the registration roller 24. The transport roller 23 adjusts a position of the sheet S at the tip end in the transport direction by bending the sheet S. The registration roller 24 aligns the tip end of the sheet S which is sent from the transport roller 23 in the nip N. In addition, the registration roller 24 transports the sheet S to a transfer unit 28.

Toner cartridges 16Y, 16M, 16C, and 16K each of which accommodates a toner are mounted on the toner supply unit 6. Toners of colors of yellow, magenta, cyan, and black are respectively accommodated in the toner cartridges 16Y, 16M, 16C, and 16K. A supply tube 17 is provided in the toner supply unit 6. Toners discharged from the toner cartridges 16Y, 16M, 16C, and 16K circulate in the supply tube 17.

Figure 2:
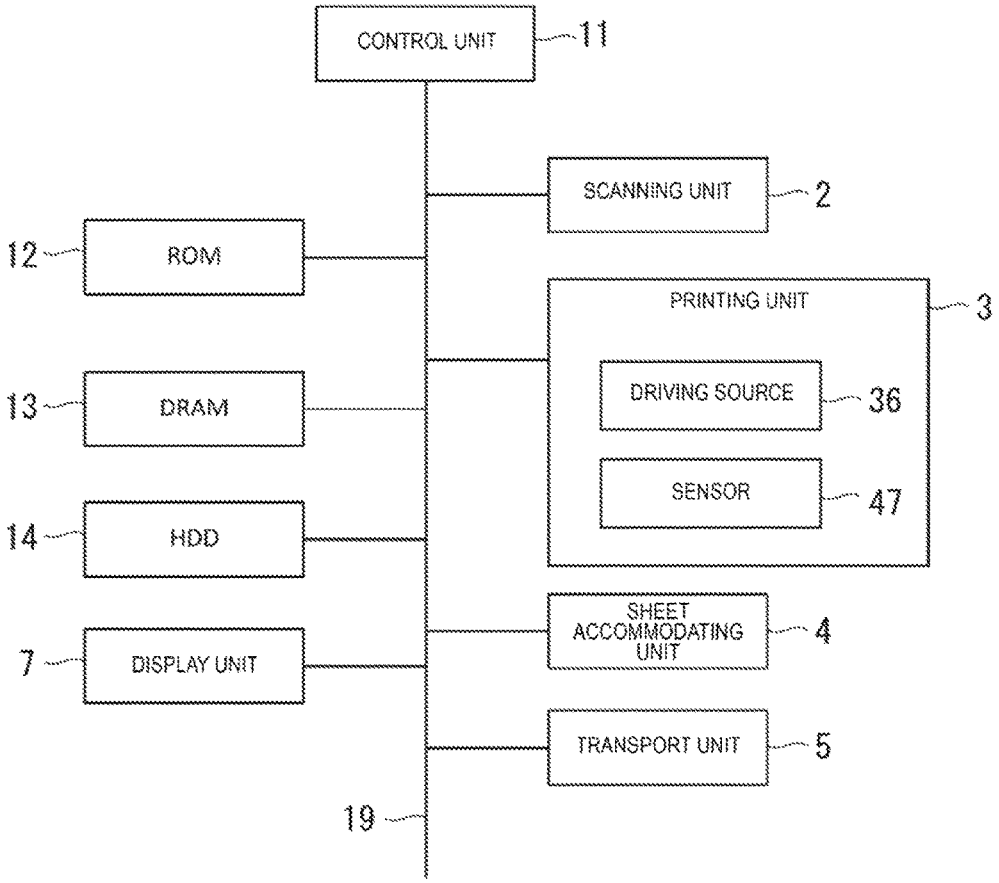
FIG. 2 is a schematic block diagram of an image forming apparatus.

FIG. 2 is a block diagram of the image forming apparatus according to the embodiment.

As illustrated in FIG. 2, the image forming apparatus 1 is further provided with a ROM 12, a DRAM 13, and a hard disk drive (HDD) 14. The functional portions are connected to each other so as to perform data communication through a system bus 19. The scanning unit 2, the printing unit 3, the sheet accommodating unit 4, the transport unit 5, and the toner supply unit 6 include a device such as a sensor or a driving source, such as a motor, which is controlled by the control unit 11.

The control unit 11 controls the devices which are connected to each other through the system bus 19. The ROM 12 stores various control programs which are necessary for operations of the control unit 11. The DRAM 13 is used as a temporary storage region of data when the control unit 11 executes a program. The HDD 14 stores data which is used for the control. The HDD 14 stores a reference value of a toner ratio concentration in a developing device 44, for example. The HDD 14 stores various messages to be displayed on the display unit 7, for example. The HDD 14 stores data obtained by the control unit 11 executing a program, for example.

Hereinafter, the printing unit 3 will be described in further detail.

As illustrated in FIG. 1, the printing unit 3 includes image forming portions 25Y, 25M, 25C, and 25K, an intermediate transfer belt 27, the transfer unit 28, and a fixing unit 29.

The intermediate transfer belt 27 is an endless belt (a loop). Tension is applied to the intermediate transfer belt 27 using a plurality of rollers in contact with the inner peripheral faces of the intermediate transfer belt 27. The intermediate transfer belt 27 is flatly stretched. The inner peripheral face of the intermediate transfer belt 27 is in contact with a support roller 28*a* and a transfer belt roller 30 at a position farthest from the support roller 28*a* in the stretching direction.

The support roller 28*a* is a part of the transfer unit 28 which will be described later. The support roller 28*a* guides the intermediate transfer belt 27 to a secondary transfer position.

The image forming portions 25Y, 25M, 25C, and 25K are disposed in this order on the lower side of the intermediate transfer belt 27 from the transfer belt roller 30 toward the transfer unit 28 side. The image forming portions 25Y, 25M, 25C, and 25K are spaced from each other in a region between the transfer belt roller 30 and the support roller 28*a*. The image forming portion 25Y forms a toner image of yellow which is transferred to the sheet S on the intermediate transfer belt 27. The image forming portion 25M forms a toner image of magenta which is transferred to the sheet S on the intermediate transfer belt 27. The image forming portion 25C forms a toner image of cyan which is transferred to the sheet S on the intermediate transfer belt 27. The image forming portion 25K forms a toner image of black which is transferred to the sheet S on the intermediate transfer belt 27. Each of the image forming portions 25Y, 25M, 25C, and 25K is similarly formed. In the following descriptions of configurations of the image forming portions 25Y, 25M, 25C, and 25K, the image forming portion 25Y will be described as an example.

The image forming portion 25Y includes an image forming unit 32, and a primary transfer roller 34.

Figure 3:
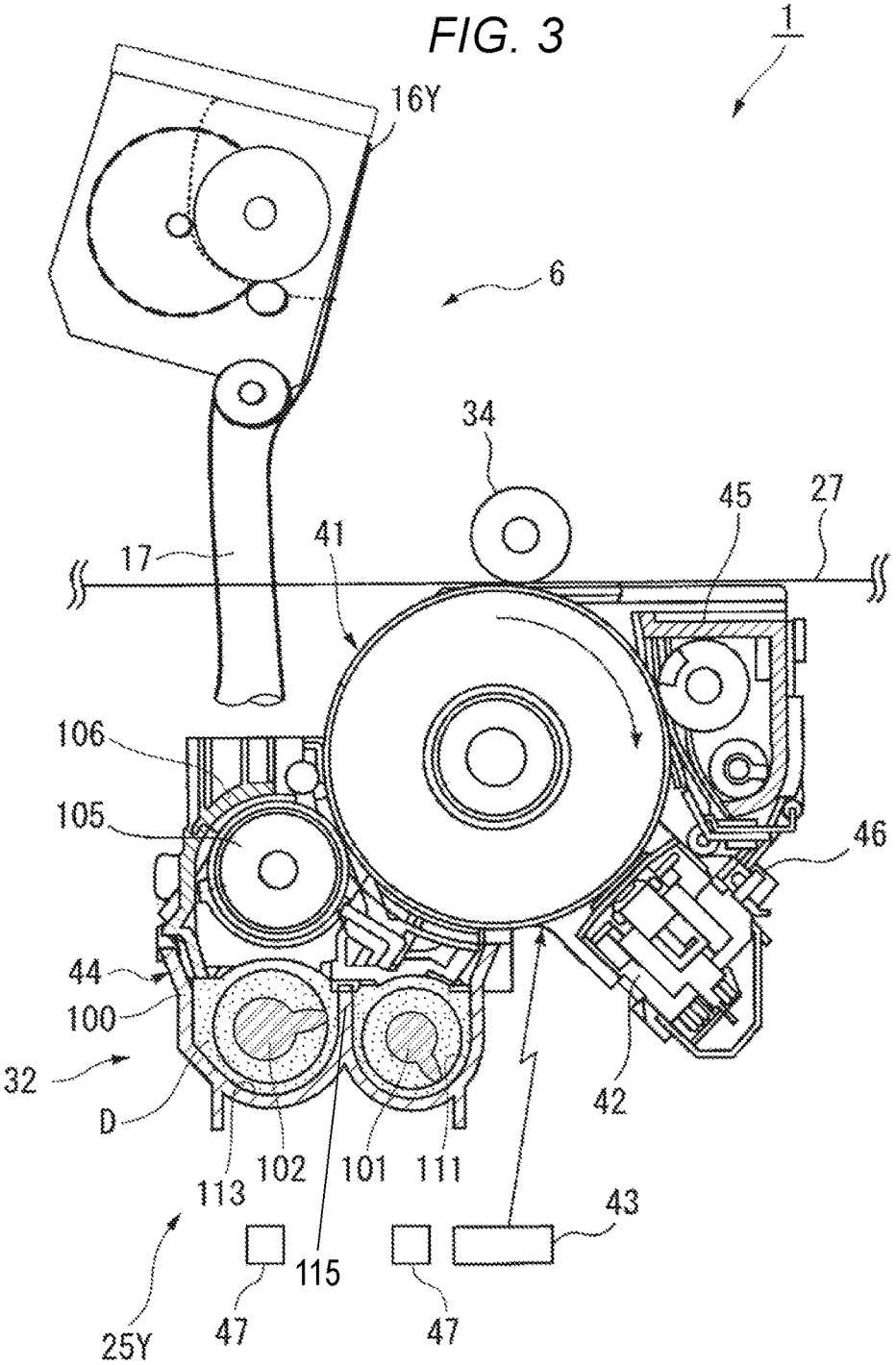
FIG. 3 is a cross-sectional front view of an image forming portion.

FIG. 3 is a cross-sectional front view of the image forming portion according to the embodiment.

As illustrated in FIG. 3, the image forming unit 32 includes a photoconductive drum 41, a charger 42, an exposure unit 43, a developing device 44, a cleaning unit 45, a static eliminator 46, and a sensor 47.

The photoconductive drum 41 is disposed below the intermediate transfer belt 27. The photoconductive drum 41 faces the lower face of the intermediate transfer belt 27.

In a periphery of the photoconductive drum 41, the charger 42, the exposure unit 43, the developing device 44, the primary transfer roller 34, the cleaning unit 45, and the static eliminator 46 are disposed in a clockwise direction in the front view.

The charger 42 charges the photoconductive drum 41. The charger 42 includes a discharging wire or a needle electrode as a charging electrode.

The exposure unit 43 radiates LED light in accordance with image information on the surface of the photoconductive drum 41. The exposure unit 43 can also be a laser light source which emits laser light. Image information of yellow is supplied to the exposure unit 43 of the image forming portion 25Y. The exposure unit 43 radiates LED light based on image information to the photoconductive drum 41 which has been charged. The exposure unit 43 forms an electrostatic latent image based on the image information of yellow on the surface of the photoconductive drum 41.

The developing device 44 of the image forming portion 25Y accommodates a developer D containing a yellow toner. The developing device 44 charges the accommodated toner. The toner accommodated in the developing device 44 is supplied from the toner cartridge 16Y. The developing device 44 supplies the charged toner to the surface of the photoconductive drum 41 which the developing device faces. The toner adheres to the surface of the photoconductive drum 41 according to the electrostatic latent image. The developing device 44 develops the electrostatic latent image which is formed by the exposure unit 43.

Figure 4:
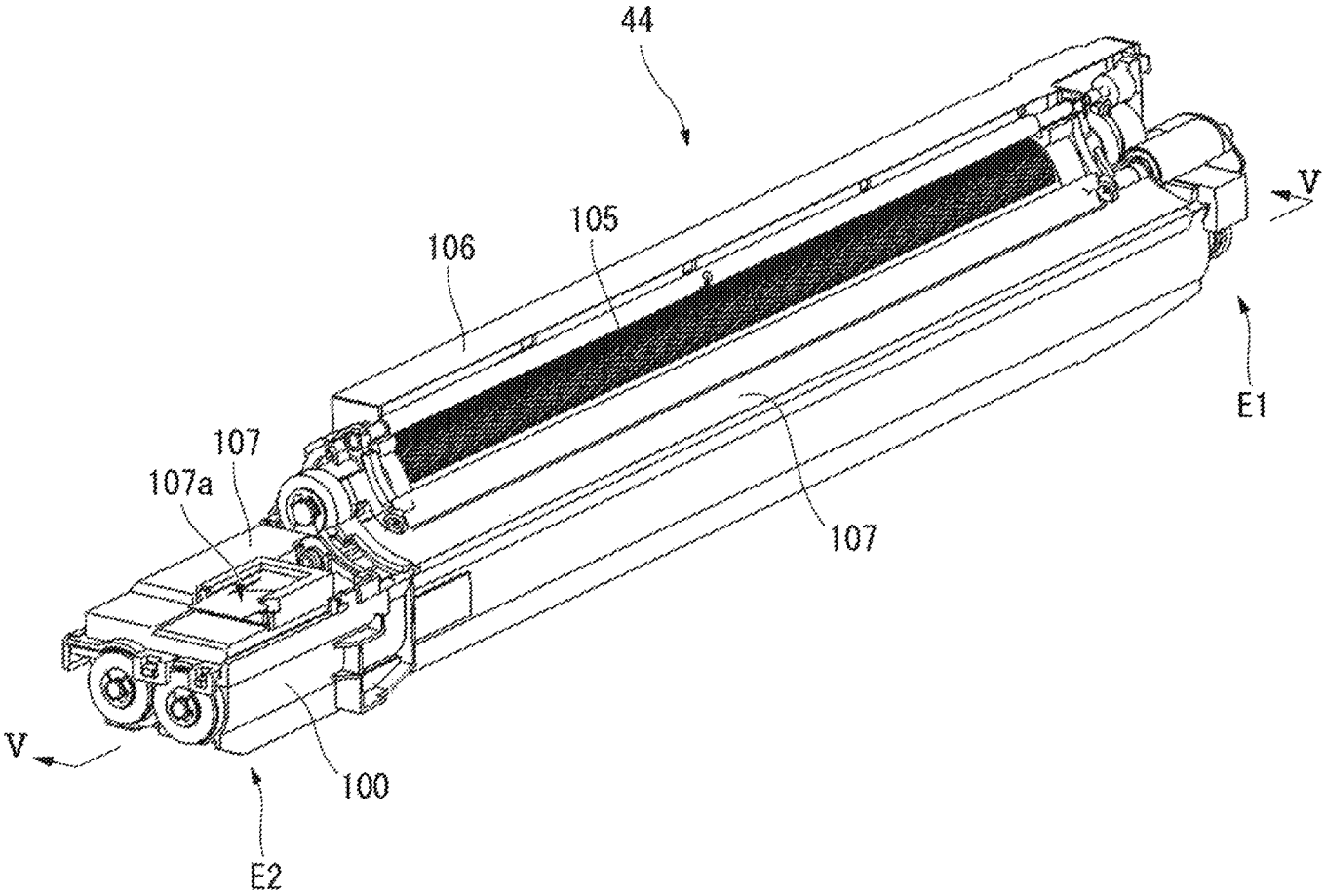
FIG. 4 is a perspective view of a developing device.

FIG. 4 is a perspective view of the developing device.

Figure 5:
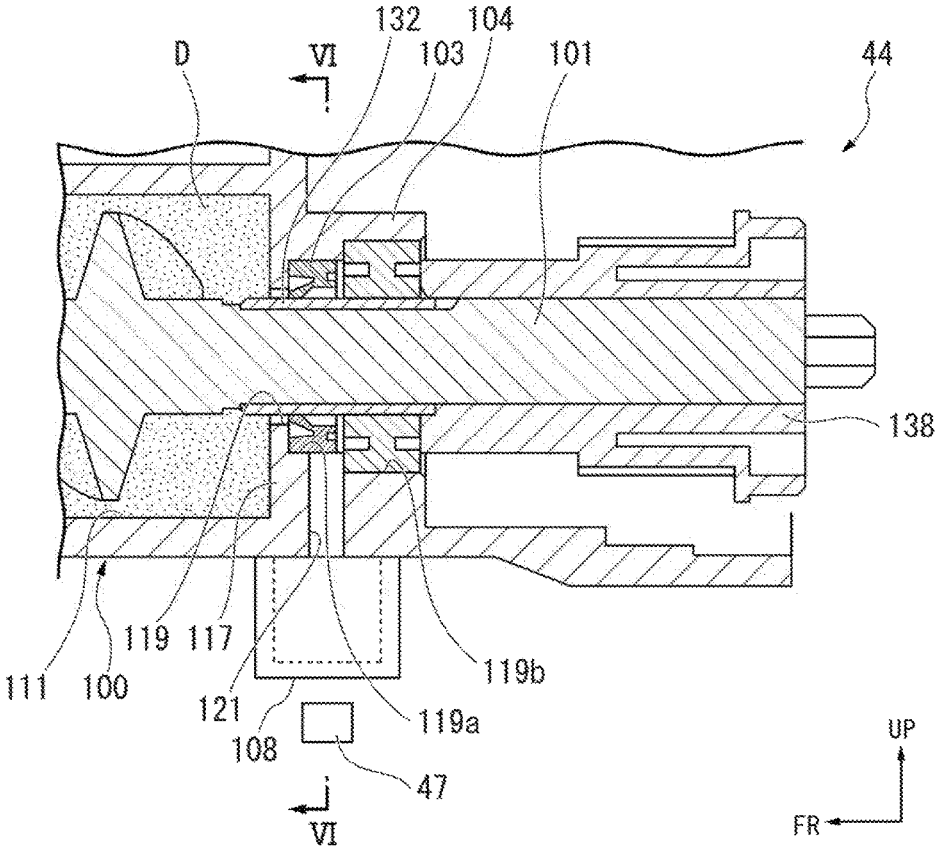
FIG. 5 is a cross-sectional view of a first end portion of a developing device along V-V in FIG. 4.

As illustrated in FIGS. 3-5, the developing device 44 includes a casing 100, a first mixer 101 (referred to as a rotating body), a second mixer 102 (also referred to as a rotating body), a sealing member 103 (see FIG. 5), a bearing 104, a developing roller 105, a first cover 106, a second cover 107, and a developer receiver 108.

The casing 100 is a container which accommodates the developer D. When the developer D is agitated, toner is frictionally charged. The toner adheres to the surface of a carrier in the developer D.

The casing 100 extends over the longitudinal direction from a first end portion E1 to a second end portion E2 of the developing device 44. Here, the first end portion E1 of the developing device 44 is an end portion which faces the rear side of the printing unit 3. The second end portion E2 of the developing device 44 is an end portion which faces the front side of the printing unit 3.

As illustrated in FIG. 3, groove portions 111 and 113 which open to the upper part are formed inside the casing 100. The groove portions 111 and 113 extend along the longitudinal direction (also referred to as an anteroposterior direction) from the first end portion E1 toward the second end portion E2. The groove portions 111 and 113 align in the horizontal direction (also referred to as a short direction). Each of the sections orthogonal to the longitudinal direction of the groove portions 111 and 113 is formed in a U shape, respectively. A partitioning plate 115 is at a boundary between the groove portions 111 and 113 in the short direction.

The first mixer 101 and the second mixer 102 are disposed inside the groove portions 111 and 113 of the casing 100, respectively. Center axial lines of the respective first mixer 101 and the second mixer 102 extend along the longitudinal direction of the developing device 44. That is, the axial direction of the respective first mixer 101 and the second mixer 102 matches the longitudinal direction. The first mixer 101 and the second mixer 102 include a spiral impeller.

FIG. 5 is a cross-sectional view of a first end portion of the developing device along the line V-V in FIG. 4. The arrow UP in FIG. 5 denotes the upward direction, and the arrow FR denotes the direction towards the front of the printing unit 3.

As illustrated in FIG. 5, both ends of the first mixer 101 are rotatably supported by the casing 100. The first mixer 101 is inserted from the first end portion E1 towards the second end portion E2 of the developing device 44 inside the casing 100. The first mixer 101 includes collars 132 which are outwardly fitted to an insertion portion of the casing 100.

The collar 132 is formed in a cylindrical shape using a metal. The collar 132 is formed using molding. The first mixer 101 includes a gear 138 on the outer side of the first end portion E1 of the developing device 44 inside the casing 100.

The second mixer 102 has the same configuration as that of the first mixer 101. The gear 138 of the first mixer 101 and a gear 138 of the second mixer 102 engage with each other. A coupler which is connected to a driving source 36, depicted in FIG. 2, is provided in the gear 138 of the first mixer 101. The first mixer 101 and the second mixer 102 are driven to rotate by the driving source 36.

As illustrated in FIG. 3, when the first mixer 101 and the second mixer 102 are rotate by the driving source 36, the developer D in the groove portions 111 and 113 is agitated. The first mixer 101 and the second mixer 102 transport the developer D in the longitudinal direction of the developing device 44. The driving source 36 is connected to the system bus 19, and is controlled by the control unit 11, depicted in FIG. 2.

Figure 6:
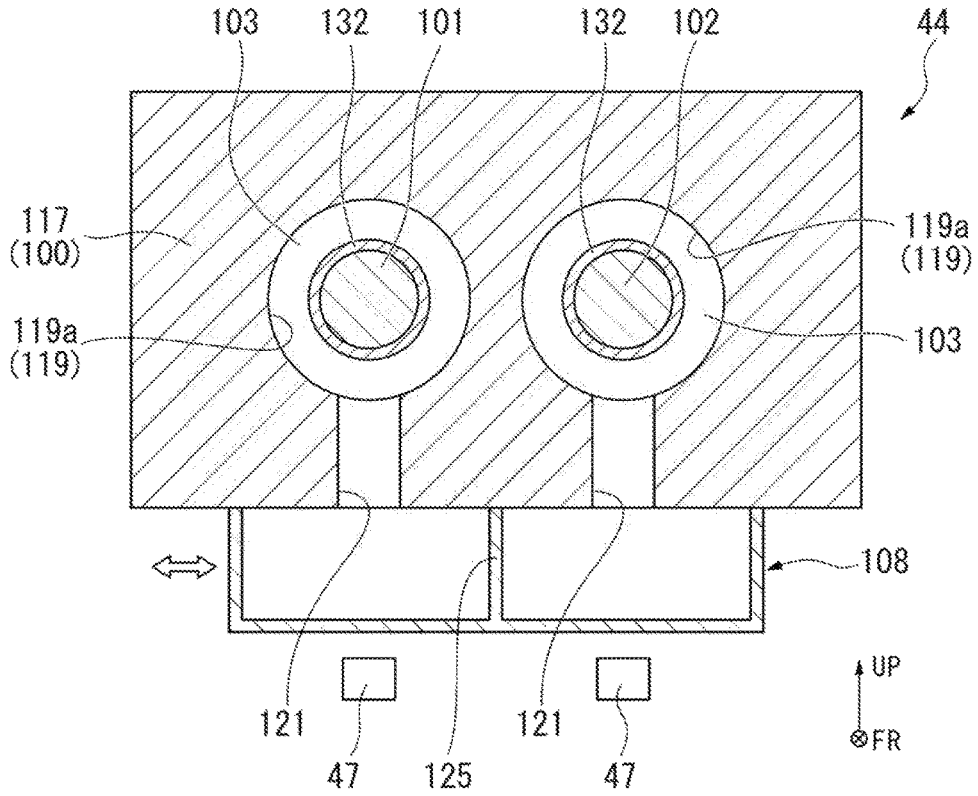
FIG. 6 is a cross-sectional view of a developing device along VI-VI in FIG. 5.

FIG. 6 is a cross-sectional view of the developing device along VI-VI in FIG. 5.

As illustrated in FIGS. 5 and 6, the sealing member 103 is outwardly inserted into both end portions of the first mixer 101 and the second mixer 102. The sealing member 103 is formed in an annular shape. The sealing member 103 is in contact with and can slide along the outer peripheral faces of the first mixer 101 and the second mixer 102. The sealing member 103 is supported by the casing 100.

As illustrated in FIG. 5, the bearings 104 are outwardly inserted into the both end portions of the first mixer 101 and the second mixer 102, respectively. The bearing 104 is disposed on the outer side of the sealing member 103. The outer side is outside of the casing 100. The bearing 104 is supported by the casing 100.

As illustrated in FIG. 4, a developing roller 105, the first cover 106, and the second cover 107 are disposed above the casing 100. The developing roller 105, the first cover 106, and the second cover 107 face an opening of the casing 100.

As illustrated in FIG. 3, the developing roller 105 supplies the developer D to the surface of the photoconductive drum 41. The developing roller 105 develops an electrostatic latent image on the surface of the photoconductive drum 41. The developing roller 105 is disposed along an opening of the groove portion 113. The surface of the developing roller 105 is close to the surface of the photoconductive drum 41. The developing roller 105 is connected to the driving source 36 which rotates the first mixer 101 and the second mixer 102 in the first end portion E1 of the developing device 44, for example.

The first cover 106 covers the surface of the developing roller 105 except for a portion proximate to the photoconductive drum 41 at the upper part of the groove portion 113.

As illustrated in FIG. 4, the second cover 107 covers a portion which is not covered with the developing roller 105 and the first cover 106 at the upper part of the casing 100. In the second cover 107, a developer supply port 107*a* is formed in the second end portion E2 of the developing device 44. The supply tube 17, depicted in in FIG. 3, of the toner supply unit 6 is connected to the developer supply port 107*a*.

Hereinafter, the first end portion E1 of the developing device 44 will be described in further detail. The first end portion E1 of the developing device is the same as the second end portion E2, detailed descriptions of the second end portion E2 will be omitted.

As illustrated in FIGS. 5 and 6, an insertion hole 119, also referred to as an insertion portion, and a dropping hole 121, also referred to as a through-hole, are formed on a wall portion 117 of the first end portion E1 of the casing 100. A pair of the insertion holes 119 is aligned in the horizontal direction. The insertion hole 119 penetrates the wall portion 117 of the first end portion E1 of the casing 100 in the anteroposterior direction. The insertion hole 119 has a circular shape. An end portion which faces the rear side of the first mixer 101 is inserted into the insertion hole 119 on the right side. An end portion which faces the rear side of the second mixer 102 is inserted into the insertion hole 119 on the left side.

As illustrated in FIG. 5, the insertion hole 119 includes a seal holding portion 119*a* in which the sealing member 103 is disposed, and a bearing holding portion 119*b* in which the bearing 104 is disposed. The seal holding portion 119*a* holds the sealing member 103. The sealing member 103 is press-fitted to the seal holding portion 119*a*. The sealing member 103 blocks between the inner peripheral face of the insertion hole 119 and the outer peripheral face of the first mixer 101. The seal holding portion 119*a* is provided on the outer side of an opening edge in the casing 100 in the insertion hole 119. The seal holding portion 119*a* is formed by the peripheral face which extends in a fixed inner diameter in the anteroposterior direction, and a stepped face which extends from an end edge in the inside of the peripheral face in the anteroposterior direction toward the inside in the radial direction. A dimension of the seal holding portion 119*a* in the anteroposterior direction is larger than that of the sealing member 103 in the anteroposterior direction. The sealing member 103 is disposed inside the seal holding portion 119*a* in the anteroposterior direction. The sealing member 103 is in contact with the stepped face of the seal holding portion 119*a*.

The bearing holding portion 119*b* holds the bearing 104. The bearing holding portion 119*b* is provided on the outer side of the seal holding portion 119*a* in the insertion hole 119. The bearing holding portion 119*b* is adjacent to the seal holding portion 119*a*. The bearing holding portion 119*b* is formed by the peripheral face which extends in a fixed inner diameter in the anteroposterior direction, and a stepped face which extends from an end edge in the inside of the peripheral face in the anteroposterior direction toward the inside in the radial direction. The inner diameter of the bearing holding portion 119*b* is larger than that of the seal holding portion 119*a*. The bearing 104 is in contact with the stepped face of the bearing holding portion 119*b*.

As illustrated in FIGS. 5 and 6, a pair of the dropping holes 121 is provided, corresponding to each insertion hole 119. The dropping hole 121 penetrates the casing 100 from the seal holding portion 119*a* of the insertion hole 119 toward the lower part. The dropping hole 121 is formed at an outer end portion of the seal holding portion 119*a* of the insertion hole 119 in the anteroposterior direction. The dropping hole 121 is formed on the outer side of the sealing member 103 in the anteroposterior direction. The dropping hole 121 is overlapped with the outer end portion of the sealing member 103 in the anteroposterior direction when viewed in the vertical direction.

The developer receiver 108 is disposed under the dropping hole 121. The developer receiver 108 receives the developer D which falls from the dropping hole 121. The developer receiver 108 is formed in a box shape which is open to the upper part. The developer receiver 108 is formed of a transparent material such as a resin, for example. The developer receiver 108 is provided under the pair of dropping holes 121 on the left and right by straddling thereof. The developer receiver 108 can slide along the horizontal direction with respect to the casing 100 when being detached. A partition wall 125 is provided inside the developer receiver 108. The partition wall 125 extends from the lower face in the developer receiver 108 toward the upper part. The partition wall 125 also extends along the antero-posterior direction. The partition wall 125 is provided between the dropping holes 121 on the left and right when viewed in the vertical direction. The partition wall 125 divides the inside of the developer receiver 108 into a lower space of the dropping hole 121 on the left side and a lower space of the dropping hole 121 on the right side.

As illustrated in FIG. 3, the cleaning unit 45 removes un-transferred toner on the surface of the photoconductive drum 41 by scraping, or the like after the primary transfer.

The static eliminator 46 radiates light onto the surface of the photoconductive drum 41 which passed through the cleaning unit 45. The static eliminator 46 eliminates charges on the photoconductive drum 41.

The sensor 47 is disposed under the developing device 44. The sensor 47 is provided under each of the dropping holes 121. The sensor 47 detects the developer D in the developer receiver 108. The sensor 47 is an optical sensor, for example. The sensor 47 detects a change in light which is transmitted through the developer receiver 108, for example. The sensor 47 is connected to the system bus 19, and is controlled by the control unit 11, depicted in refer FIG. 2.

The primary transfer roller 34 is a conductive roller. The primary transfer roller 34 is in contact with the photoconductive drum 41 in a pressing manner through the intermediate transfer belt 27. A transfer bias voltage is applied to the primary transfer roller 34. In this manner, a toner image is primarily transferred to the intermediate transfer belt 27.

As illustrated in FIG. 1, in the intermediate transfer belt 27, the transfer unit 28 is disposed on the downstream side of the image forming portion 25K. The transfer unit 28 transfers the toner image on the intermediate transfer belt 27 onto the surface of the sheet S in the secondary transfer position. The secondary transfer position is a position at which the support roller 28*a* and the secondary transfer roller 28*b* face each other. The transfer unit 28 applies a transfer bias, which is controlled by a transfer current, to the secondary transfer position. The transfer unit 28 transfers the toner image on the intermediate transfer belt 27 to the sheet S using the transfer bias.

The fixing unit 29 fixes the toner image to the sheet S using heat and pressure applied to the sheet S.

Hereinafter, operations of a developing device according to the embodiment will be described.

The developer D in the casing 100 may leak from inside of the casing 100 through a portion between the first mixer 101, or the second mixer 102, and the sealing member 103. However, according to an embodiment, the dropping hole 121 which extends downward from the seal holding portion 119*a* is formed in the casing 100 on the outer side of the sealing member 103. Thus, the developer D which leaks from inside of the casing 100 by passing through the portion between the first mixer 101, or the second mixer 102, and the sealing member 103 falls in the dropping hole 121. Therefore, it is possible to prevent the developer D leaked from inside of the casing 100 from remaining inside the insertion hole 119. It is possible to reduce adhering of the developer D to a movable portion at the periphery of the insertion hole 119. Accordingly, it is possible to suppress an occurrence of a rotation failure of the first mixer 101 or the second mixer 102.

In particular, the first mixer 101 includes the gear 138 at the end portion, which also applies to the second mixer 102. Thus, it is possible to suppress a situation in which the developer D leaked from the inside of the casing 100 adheres to the gear 138, causing the gear 138 to be chipped. Accordingly, it is possible to suppress an occurrence of a rotation failure of the first mixer 101 or the second mixer 102.

The dropping hole 121 is formed inside the bearing 104. Thus, the developer D leaked from the inside of the casing 100 falls in the dropping hole 121 before reaching the bearing 104. Accordingly, it is possible to prevent the developer D leaked from the inside of the casing 100 from adhering to the bearing 104. Therefore, it is possible to suppress fixing or lock-up of the bearing 104 that would otherwise be caused by the adhering of the developer D.

The developing device 44 includes the developer receiver 108 which can receive the developer D which falls through the dropping hole 121. In this manner, it is possible to suppress scattering of the developer D which falls through the dropping hole 121. It is possible to check whether or not the developer D falls from the dropping hole 121, by checking a presence or absence of the developer D which is received in the developer receiver 108. In this manner, it is possible to check whether or not the developer D leaks from the inside of the casing 100.

The developer receiver 108 is formed so as to be detachable from the casing 100. Thus, the developer D is removed from the developer receiver 108 when the developer D leaks, and re-attached to the casing 100 when the developer receiver 108 is used.

The developer receiver 108 is attached to and detached from the casing 100 along the horizontal direction. Thus, it is possible to suppress scattering of the developer D when the developer receiver 108 moves in the vertical direction, when the developer receiver 108 receives the developer D. Accordingly, it is possible to suppress a situation in which the developer D scatters at the periphery of the developing device 44, and adheres to the developing device.

The developer receiver 108 is formed of a transparent material. Thus, it is possible to check a presence or absence of the developer D which is received in the developer receiver 108, without detaching the developer receiver 108 from the casing 100. Accordingly, it is possible to easily check whether or not the developer D leaks from the casing 100.

The developer receiver 108 is provided by straddling the lower part of the pair of dropping holes 121 on the left and right. Thus, it is possible to reduce the number of components compared to a case in which the developer receiver 108 is individually provided at the respective lower part of the pair of dropping holes 121 on the left and right.

The developer receiver 108 includes the partition wall 125 which is provided between the pair of dropping holes 121 on the left and right, when viewed in the vertical direction. For this reason, it is possible to discriminate from which dropping holes 121 on the left and right the developer D falls, by checking in which partition wall 125 on the left and right the developer D is received. Accordingly, it is possible to discriminate from which insertion holes 119 on the left and right the developer D leaks.

The image forming apparatus 1 includes the sensor 47 which detects falling of the developer D into the developer receiver 108. For this reason, the image forming apparatus 1 can inform a user of an occurrence of leaking of the developer D, without causing the user to check the developer receiver 108.

The sensor 47 detects falling of the developer from under the dropping hole 121. For this reason, it is possible to discriminate from which dropping hole 121 the developer D falls, when the plurality of insertion holes 119 are aligned in a line. Accordingly, it is possible to exactly inform a user of a portion at which leaking of the developer D has occurred.

A position at which the dropping hole 121 is formed is not limited to the position in the above described embodiment. In the dropping hole, at least a part thereof may be open to the outer side of the sealing member 103 in the anteroposterior direction, on the lower face of the insertion hole 119. In the dropping hole, at least a part thereof may be open to inside of the bearing 104 in the anteroposterior direction, on the lower face of the insertion hole 119.

According to at least one of the above described embodiments, the dropping hole which extends downward from the insertion hole on the outer side of the sealing member is formed in the casing. For this reason, it is possible to prevent the developer leaked from the inside of the casing from remaining in the insertion hole. Accordingly, it is possible to suppress adhering of the developer to the movable portion at the periphery of the insertion hole. Accordingly, it is possible to suppress an occurrence of a rotation failure of the first mixer and the second mixer.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A developing device, comprising:

a casing for accommodating a developer, the casing extending in a first direction and including a first insertion portion, a first through-hole that extends from the first insertion portion in a second direction, a second insertion portion, and a second through-hole that extends from the second insertion portion in the second direction;

a first rotating body extending in the first direction through the first insertion portion and configured to transport and agitate the developer in the casing;

a second rotating body extending in the first direction through the second insertion portion and configured to transport and agitate the developer in the casing;

a first sealing member inside the first insertion portion, in contact with an outer surface of the first rotating body, and configured to slide along the outer surface of the first rotating body;

a second sealing member inside the second insertion portion, in contact with an outer surface of the second rotating body, and configured to slide along the outer surface of the second rotating body; and a developer receiver positioned under the first through-hole and the second through-hole in the second direction, and configured to receive developer which falls through the first through-hole and developer which falls through the second through-hole, the developer receiver including a partition wall between a space under the first through-hole and a space under the second through-hole.

2. The developing device according to claim 1, further comprising:

a bearing on a side of the first sealing member opposite to a side of the first sealing member facing a space of the casing for accommodating the developer, wherein the first through-hole extends through the bearing.

3. The developing device according to claim 1, wherein the developer receiver is detachably mounted to the casing.

4. The developing device according to claim 3, wherein the developer receiver is configured to slide in a third direction when the developer receiver is mounted to the casing or detached from the casing.

5. The developing device according to claim 1, wherein the developer receiver is formed of a transparent material.

6. A developing device, comprising:

a casing for accommodating a developer, the casing extending in a first direction and including a first insertion portion and a first through-hole that extends from the first insertion portion in a second direction;

a first sealing member inside the first insertion portion;

a first rotating body extending in the first direction through the first insertion portion and configured to transport and agitate the developer in the casing;

a developer receiver under the first through-hole in the second direction and configured to receive developer which falls through the first through-hole; and a bearing on a side of the first sealing member opposite to a side of the first sealing member facing a space of the casing for accommodating the developer, the first through-hole extending through the bearing, wherein the first sealing member is in contact with an outer surface of the first rotating body and configured to slide along the outer surface of the first rotating body, and the developer receiver is detachably mounted to the casing.

7. The developing device according to claim 6, wherein the developer receiver is configured to slide in a third direction when the developer receiver is mounted to the casing or detached from the casing.

8. The developing device according to claim 6, wherein the developer receiver is formed of a transparent material.

9. The developing device according to claim 6, further comprising:

a second sealing member; and a second rotating body, wherein the casing further includes a second insertion portion and a second through-hole that extends from the second insertion portion in the second direction, the second sealing member is inside the second insertion portion and in contact with an outer surface of the second rotating body and configured to slide along the outer surface of the second rotating body, the second rotating body extends in the first direction through the second insertion portion and configured to transport and agitate the developer in the casing, and the second through-hole is above the developer receiver in the second direction such that the developer receiver receives developer which falls through the first through-hole and the second through-hole.

10. The developing device according to claim 9, wherein the developer receiver includes a partition wall between a space under the first through-hole and a space under the second through-hole.

11. An image forming apparatus, comprising:

a developing device having:

a casing for accommodating a developer, the casing extending in a first direction and including a first insertion portion and a first through-hole that extends from the first insertion portion in a second direction;

a first rotating body extending in the first direction through the first insertion portion and configured to transport and agitate the developer in the casing;

a first sealing member inside the first insertion portion; and a bearing on a side of the first sealing member opposite to a side of the first sealing member facing a space of the casing for accommodating the developer, the first through-hole extending through the bearing; and a sensor configured to detect falling of the developer from under the first through-hole, wherein the first sealing member is in contact with an outer surface of the first rotating body and configured to slide along the outer surface of the first rotating body.

12. The image forming apparatus according to claim 11, further comprising:

a developer receiver under the first through-hole in the second direction and configured to receive developer which falls through the first through-hole, wherein the developer receiver is detachably mounted to the casing, and the developer receiver configured to slide in a third direction when the developer receiver is mounted to the casing or detached from the casing.

13. The image forming apparatus according to claim 12, wherein the developer receiver is formed of a transparent material.

14. The image forming apparatus according to claim 12, wherein the developing device further comprises:

a second sealing member; and a second rotating body, wherein the casing further includes a second insertion portion and a second through-hole that extends from the second insertion portion in the second direction, the second sealing member is inside the second insertion portion and in contact with an outer surface of the second rotating body and configured to slide along the outer surface of the second rotating body, the second rotating body extends in the first direction through the second insertion portion and configured to transport and agitate the developer in the casing, the second through-hole is above the developer receiver in the second direction such that the developer receiver receives developer which falls through the first through-hole and the second through-hole, and the developer receiver includes a partition wall between a space under the first through-hole and a space under the second through-hole.

* * * * *